United States Patent [19]

Sakashita

[11] Patent Number: 4,820,603

[45] Date of Patent: Apr. 11, 1989

[54] MAGNETIC TONER

[75] Inventor: Kiichiro Sakashita, Inagi, Japan

[73] Assignee: Canon Kabushiki Kaisha, Tokyo, Japan

[21] Appl. No.: 54,445

[22] Filed: May 27, 1987

[30] Foreign Application Priority Data

May 28, 1986 [JP] Japan ..... 61-122641

[51] Int. Cl.[4] ..... G03G 9/14

[52] U.S. Cl. ..... 430/106.6; 430/903

[58] Field of Search ..... 430/106.6, 109, 110, 430/111, 903

[56] References Cited

U.S. PATENT DOCUMENTS 4,626,487 12/1986 Mitsuhashi et al. ..... 430/111

4,699,865 10/1987 Mitsuhashi ..... 430/111

FOREIGN PATENT DOCUMENTS 61-34070 2/1986 Japan .

*Primary Examiner*—John L. Goodrow

*Attorney, Agent, or Firm*—Fitzpatrick, Cella, Harper & Scinto

[57] ABSTRACT

A magnetic toner comprises a binder resin and a magnetic iron oxide. The magnetic iron oxide has a silicon content of 0.1–1.5 wt. % based on the iron contained therein and is in the form fine particles containing the silicon preferentially in the inner part thereof. Because of these features, the magnetic iron oxide particles have a sharp particle size distribution, have uniform surface properties including those under various environmental conditions and freeness from agglomeration, have a good black hue, and are uniformly dispersed in the binder resin to provide a magnetic toner having uniform properties particularly suited for electrophotography.

29 Claims, 1 Drawing Sheet

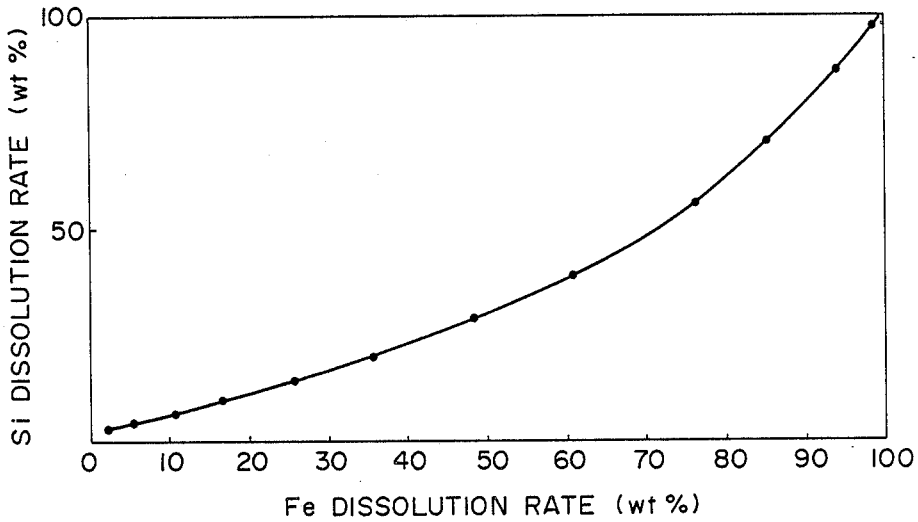
100
50
Si DISSOLUTION RATE (wt %)
0
10
20
30
40
50
60
70
80
90
100
Fe DISSOLUTION RATE (wt %)

MAGNETIC TONER

FIELD OF THE INVENTION AND RELATED ART

The present invention relates to a magnetic toner for use in image forming methods, such as electrophotography, electrostatic recording, and electrostatic printing.

Hitherto, a large number of electrophotographic processes have been known, as disclosed in U.S. Pat. Nos. 2,297,691; 3,666,363; 4,071,361, and others. In these processes, an electric latent image is formed on a photosensitive member comprising a photoconductive material by various means, then the latent image is developed and visualized with a toner, and the resultant toner image is, after transferred onto paper, etc., as desired, fixed by heating, pressing, heating and pressing, etc.

Various developing methods for visualizing electrostatic latent images have also been known. For example, there have been known the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; in addition, the fur brush developing method; and the liquid developing method. Among these developing methods, those developing methods using a developer composed mainly of a toner and a carrier such as the magnetic brush method, the cascade process and the liquid developing method have been widely used commercially. While these methods provide good images relatively stably, they involve common problems accompanying the use of two-component developers, such as deterioration of carriers and change in mixing ratio of the toner and carrier.

In order to obviate such problems, various developing methods using a one-component developer consisting only of a toner, have been proposed. Among these, there are many excellent developing methods using developers comprising magnetic toner particles.

U.S. Pat. No. 3,909,258 has proposed a developing method using an electroconductive magnetic toner, wherein an electroconductive magnetic toner is carried on a cylindrical electroconductive sleeve provided with a magnet inside thereof and is caused to contact an electrostatic image to effect development. In this method, as the development zone, an electroconductive path is formed with toner particles between the recording member surface and the sleeve surface and the toner particles are attached to image portions due to a Coulomb's force exerted from the image portions to effect development. This method using an electroconductive magnetic toner is an excellent method which has obviated the problems involved in the two-component developing methods. However, as the toner is electroconductive, there is involved a problem that it is difficult to transfer the developed image electrostatically from the recording member to a final support member such as plain paper.

As a developing method using a magnetic toner with a high resistivity which can be electrostatically transferred, a developing method using a dielectric polarization of toner particles is known. Such a method, however, involves essential problems that the developing speed is slow and a sufficient density of developed image cannot be obtained and is difficult to reduce into a commercial practice.

As another method using a high resistivity magnetic toner, there are known methods wherein toner particles are triboelectrically charged through friction between toner particles or friction between a friction member such as a sleeve and toner particles, and then caused to contact an electrostatic imagebearing member to effect development. However, these methods involve problems that the triboelectric charge is liable to be insufficient because the number of friction between the toner particles and the friction member, and the charged toner particles are liable to agglomerate on the sleeve because of an enhanced Coulomb's force, so that it is difficult to reduce these methdos to a commercial practice.

However, a developing method having eliminated the above described problems has been proposed in U.S. Pat. No. 4,395,476. In this method, a magnetic toner is applied in a very small thickness on a sleeve, triboelectrically charged and is brought to an extreme vicinity to an electrostatic image to effect development. More specifically, in this method, an excellent image is obtained through such factors that a sufficient triboelectric charge can be obtained because a magnetic toner is applied onto a sleeve in a very small thickness to increase the opportunity of contact between the sleeve and the toner; the toner is carried by a magnetic force, and the magnet and the toner are relatively moved to disintegrate the agglomerate of the toner and cause sufficient friction between the toner and the sleeve; and the toner layer is caused to face an electrostatic image under a magnetic field and without contact to effect development.

In the known jumping developing method as described above, on repeated copying, the evenness or uniformity of the magnetic toner layer or developer layer formed on a developer-carrying member can be impared in some cases. More specifically, there can occur coating irregularities, such as streak coating irregularity appearing in the circumferential direction on the toner carrying member, and local thickening of the carried developer layer compared with that in the initial stage, resulting in dot irregularieis and ripple coating irregularity. On developing, the former leads to a white streak in a developed image, and the latter leads to density irregularities in dots or ripples. The above phenomena seldom occur in a normal repetitive copying, but can occur in a continuous use particularly under low temperature-low humidity conditions and are not desirable because they lead to lowering in image density in such a continuous use.

Even under high temperature-high humidity conditions, the developer can change in thickness to be thin, thus resulting in lowering of image density. As a result of study on these points, it has been found that the phenomena are caused by change in attachment of the magnetic toner on a sleeve (i.e., developer carrying member) and transfer of the magnetic toner from the sleeve to a photosensitive member.

As a result of further investigation, it has been found that the above phenomena are caused by partial or local irregularity in triboelectric charge of the developer layer on the carrying member due to change in environmental conditions. More specifically, under the environmental conditions of low temperature and low humidity, a component of the developer can have an extremely large triboelectric charge through friction between the carrying member surface and the developer, so that the component having the extremely large triboelectric charge is liable to be accumulated in the vicinity of the carrying member due to an image force attributable to the charge. During continuous copying, the component affects the uniformity in coating and developing performance of the upper portion of the developer layer to result in the above mentioned phenomena of coating irregularities of white streaks, dots and ripples. The decrease in thickness of the developer layer under the high temperature-high humidity conditions is also attributable to ununiformity of triboelectrification between the developer and the carrying member, and the instability of triboelectric charge of the developer in the vicinity of the carrying member surface.

Because of the ununiformity in triboelectric charge of the developer, ground fog is caused to provide a serious problem in image. In recent years, a copying machine is caused to have a variety of functions including one wherein a part of an image is erased by exposure and another image is then inserted in the part to provide a multiple, multicolor copy. Further, according to another function, a peripheral portion of a transfer paper is erased into white. In such functions, it is problematic that portions to be erased in white is accompanied with fog.

When a part of an image is erased by exposure to strong light from an LED or fuse lamp, there is observed an increased tendency of fog in the part. Further, in a case of multiple copying in multi-colors, mixing of colors can occur to impair the clarity of the resultant image.

With respect to production of magnetic iron oxide through an aqueous solution reaction, various proposals have been made in respects of kinds of an alkali used for neutralization and the pH of a solution containing ferrous hydroxide after the neutralization. However, the thus produced magnetic iron oxide particles still leave a room for improvement in environmental characteristics.

As a method for improving magnetic iron oxide, addition of a constituent of a spinnel ferrite represented by a divalent metal is known. In addition thereto, there is also known a method of adding silicic acid, alulminum, phosphoric acid, etc., as proposed by Japanese Patent Laid-Open Appln. No. 2226/1983. Silicic acid as an additive has been known to show an effect of improving heat resistance by coating the particle surfaces (e.g., Japanese Patent Laid-Open Appln. No. 35697/1978. If it is used in a magnetic toner, however, a silicic acid component such as a silicate or silicic acid hydrate is liable to remarkably impair the moisture resistance.

Through the use of a mineral acid at a low concentration for quantitative evaluation of a silicic acid component contained at particle surfaces, it has now been found that not only the silicic acid component can be easily measured quantitatively but also the distribution of the silicic acid component can be measured (Mat. Res. Bull., Vol. 20, pp 85-92). A magnetic iron oxide produced through an aqueous solution reaction without intentional addition of silicic acid was evaluated by using the above technique. As a result, it was found that a considerable amount of silicic acid inevitably introduced from the ferrous salt, neutralizing agent and water for solution was detected from the particle surfaces with respect to a powder sample containing spherical particles obtained by using an amount of alkali below the equivalent amount.

The above mentioned Japanese Laid-Open Patent Appln. No. 2226/1983 has proposed a process wherein a silicic acid salt is added in advance as a third component to a ferrous salt solution, but in the process, the alkali in an amount below the equivalent is added. This is not desirable because it provides a product containing a silicic acid component in a large amount at the surfaces.

On the other hand, Japanese Patent Publication No. 28203/1980 has proposed a magnetic powder containing uniformly dispersed silicic acid obtained through addition of silicic acid or a silicic acid salt simultaneously with or into an alkali for nautralization. Japanese Patent Laid-Open Appln. No. 34070/1986 has proposed the addition of a silicic acid compound to ferrous hydroxide at a time when the reaction to magnetite has proceeeded. These known process are however insufficient in localizing the silicic acid component preferentially at the central portion of the particles and preventing the remaining at the surfaces.

SUMMARY OF THE INVENTION

An object of the present invention is to provide a magnetic toner providing little change in density even under different environmental conditions.

Another object of the present invetion is to provide a magnetic toner free of so-called "charge-up", i.e., a phenomenon that a charge is excessively accumulated on the toner particles, thus failing to retain an appropriate charge and causing a decrease in density.

Another object of the present invention is to provide a magnetic toner providing clear images of a high density and free of fog.

As a result of study for achieving the above objects, it has now been found that a principal cause for the above problems resides in a magnetic material contained in a magnetic toner, and a study on a magnetic material capable of solving the problems has also been made.

As a result, a magnetic material has now been developed, which can be easily dispersed uniformly in a toner, is less liable to cause agglomeration, has a uniform surface composition, is capable of appropriately and stably controlling the charge of a toner at the time of charging. The above objects of the present invention are also accomplished by a toner using the magnetic material. A further object of the present invention is to provide a one-component insulating magnetic toner.

According to the present invention, there is provided a magnetic toner comprising: a binder resin and a magnetic iron oxide, the magnetic iron oxide satisfying the following properties: a content of silicon element of 0.1-1.5 wt. % based on the iron element; a content A (based on the iron element) of silicon element present up to about 10 wt. % dissolution of the iron element of 0.7 wt. % or less; a content B (based on the iron element) of silicon element present in the range of about 90 wt. %-100 wt. % dissolution of the iron element of 0.2-5 wt. %, and a ratio of the content B/the content A of above 1.0.

These and other objects, features and advantages of the present invention will become more apparent upon a consideration of the following description of the preferred embodiments of the present invention taken in conjunction with the accompanying drawing.

BRIEF DESCRIPTION OF THE DRAWINGS

The sole FIGURE in the drawing is a graph obtained by plotting data shown in Table 1 obtained by analysis of magnetic iron oxide containing silicon element produced in Production Example 1.

DETAILED DESCRIPTION OF THE INVENTION

The magnetic toner of the present invention contains a magnetic iron oxide in which the content of silicon element is 0.1–1.5 wt. %, preferably 0.20–1.0 wt. %, more preferably 0.25–0.70 wt. % based on the iron element. Less than 0.1 % is insufficient to provide improvements to particle characteristics desired by the present invention, and more than 1.5 wt. % increases the silicic acid component remaining on the particle surfaces.

The magnetic iron oxide used in present invention has a content A (based on the iron element) of silicon element present up to about 10 wt. % dissolution of iron element of about 0.7 wt. % or less, preferably 0.01–0.5 wt. %, a content B (based on the iron element) of silicon element in the range of 90–100 wt. % dissolution of the iron element of 0.2–5 wt. %, preferably 0.5–3.0 wt. %. The content A of silicon element up to about 10 wt. % dissolution of iron element represents the content of silicon element in the very external or superficial portion of the magnetic iron oxide particles. If this value is above 0.7 wt. %, the surface composition of the magnetic iron oxide becomes ununiform or the moisture resistance is impaired by the silicic acid component, whereby there is an increased tendency that intended effect of the present invention is not fully exhibited. The content B of silicon element in the range of 90–100 wt. % dissolution of the iron element represents the content of silicon element at the central portion or core of the magnetic iron oxide particles. If this value is less than 0.2 wt. %, the particle size distribution is not uniformized and it becomes difficult to uniformize the compositional distribution and structure of individual magnetic iron oxide particles. If it is more than 5 wt. %, the viscosity of a reaction liquid for production is increased, whereby not only the efficiency is impaired but also uniform reaction in the reaction vessel is hindered, thus resulting in individual magnetic iron oxide particles having different compositions.

The magnetic iron oxide used in the present invention has a ratio of the content B/content A is above 1.0, preferably 3–10. If the ratio is not above 1.0, the magnetic iron oxide nuclei formed at the initial stage of the magnetic iron oxide formation do not contain sufficient silicic acid component, so that it becomes difficult to produce magnetic iron oxide particles having uniform sizes and a sharp particle size distribution.

The magnetic iron oxide used in the present invention may preferably have an apparent bulk density of 0.10–0.25 g/cc. In this range, the particles are little agglomerating and primarily comprising octahedral particles, thus functioning as a magnetic iron oxide exhibiting the effects of the present invention more effectively. The magnetic iron oxide used in the present invention is excellent in affinity to a resin or an organic solvent. For example, the dispersibility in toluene shows 4 mm or less in terms of a sedimentation length after 1 hour from the commencement of standing. The dispersibility in toluene may further preferably be 3 mm or less. Because of this feature, the magnetic iron oxide can be uniformly dispersed well in a polymer component.

The magnetic iron oxide used in the present invention may preferably have an average particle size of 0.1–2.0 microns, further preferably 0.1–0.6 micron. Too small a particle size is liable to cause agglomeration and provide poor environmental characteristics. Too large a particle size causes excessive projection or localization thereof when dispersed in fine toner particles and further provides a lower blackness.

The magnetic iron oxide may preferably have a BET specific surface area by nitrogen adsorption of 0.5–20 $m^2/g$, particularly 4–20 $m^2/g$. If the specific surface area exceeds 20 $m^2/g$, there is an increased tendency for the magnetic iron oxide particles to agglomerate and have poor environmental characteristics. If the specific surface area is below 0.5 $m^2/g$, the particles are liable to excessively protrude over the surfaces of or be localized in the toner particles. Further, in the preferred specific surface area range of 4–20 $m^2/g$, the magnetic iron oxide particles are caused to have a stable dispersibility in the binder resin and provide an excellent black color in respect of hue.

The methods for measurement of various physical property data used in defining the present invention will be described hereinbelow.

The content of silicon element (based on the iron element) in the magnetic iron oxide and the dissolution rate of iron element may be obtained in the following manner. For example, about 3 l. deionized water is charged in a 5 l.-beaker and warmed at 45°–50° C. on a water bath. A slurry of about 25 g of magnetic iron oxide in about 400 ml of deionized water is added to the 5 l.-beaker while washing it with about 328 ml of deionized water.

Then, the system is held at a temperature of about 50° C., stirred at a speed of 200 rpm and about 1272 ml of a reagent-grade hydrochloric acid is added to start the dissolution. At this time, the magnetic iron oxide concentration is about 5 g/l and the aqueous hydrochloric acid solution has a concentration of about 3 normal. From the initiation of the dissolution until the complete dissolution to provide a clear solution, a 20 ml-sample is taken from the system for each 10 minutes to be filtered through a 0.1 micron-membrane filter to recover a filtrate. The filtrate is subjected to the inductively coupled plasma analysis (ICP) to determine the iron element and the silicon element.

The iron element dissolution rate (%) is calculated as:

[the iron element concentration in a sample (mg/l)/the iron element concentration in complete dissolution (mg/l)] x 100.

The content of silicon element (%) for each sample is calculated as:

[the silicon element concentration (mg/l)/the iron element concentration (mg/l)] x 100.

The apparent bulk density of magnetic iron oxide is measured in the following manner. A bulk density measuring apparatus of Powder Tester (Hosokawa Micron K.K.) is used with a 710 micron-sieve, a disintegrated sample of magnetic iron oxide is charged little by little onto the sieve under vibration at an amplitude of about 1 mm. The sieving is continued until the sieved sample is heaped up in an attached cup of 100 cc. The top of the cup is leveled with a blade. The sample magnetic iron oxide weight is meausred by subtracting the empty cup weight and the apparent density (g/cc) is calculated as:

Sample magnetic iron oxide weight (g)/100 (cc).

The dispersibility of magnetic iron oxide in toluene is evaluated in the following manner. A sample of about 1 g is weighed and charged in a precipitation tube (16.5 mm·dia. × 105 mm height, with a scale) with a fit plug, and toluene is charged to make 10 ml. The plug is fit, the tube is sufficiently stirred and is placed vertically for standing. Simultaneously with the commencement of the standing, a stopwatch is pushed, and a difference in height between the liquid level and the precipitation boundary. The difference value is used as a measure for evaluating the dispersibility in toluene of the magnetic iron oxide sample.

The average particle size and shape of magnetic iron oxide is measured or observed in the following manner. A sample is treated with a collodion film copper mesh and observed through a transmission electron microscope (H-700H, mfd. by Hitachi Seisakusho K.K.) at a voltage of 100 KV and a magnification of 10,000. A picture is taken at a printing magnification of 3 to provide an ultimate magnification of 30,000. From the picture, the shape of individual particles is observed, and the maximum lengths of the respective particles are measured to provide an average particle size by an average of the measured values.

The magnetic iron oxide containing silicon element used in the present invention may be produced, e.g., in the following process.

A ferrous salt solution is adjusted to have an Fe(II)/Fe(III) ($Fe^{++}/Fe^{+++}$) ratio of 30–100, preferably 40–60, and a silicic acid compound is added to the solution. The solution is then neutralized with the equivalent amount or more of an alkali to obtain ferrous hydroxide, which is then oxidized to produce an magnetic iron oxide containing silicon element. The magnetic iron oxide thus formed has been found to contain only a small amount of silicic acid component remaining on the surface and to be particles which contain silicic acid component localized in the center, have a uniform particle size distribution and are excellent in dispersibility.

According to observation through a transmission electron microscope, the magnetic iron oxide particles containing silicon element are found to comprise primarily octahedral particles and to be almost free of spherical particles.

More specifically, an aqueous solution of a ferrous salt such as ferrous sulfate is neutralized with an aqueous solution of an alkali in an amount exceeding the equivalent amount, and the resultant aqueous solution containing ferrous hydroxide is subjected to oxidation by aeration at a temperature of 60° C. or higher, preferably 75°–95 ° C. At this time, a silicic acid compound in an amount of 0.1–1.5 wt. % in terms of Si/Fe is added prior to or in the initial stage of the oxidation, whereby a magnetic iron oxide with excellent particle size distribution and with an enhanced dispersibility in a binder resin. The magnetic iron oxide thus formed is then subjected to removal of salts, and dried at 100°–150° C. to be obtained in a powder with a uniform particles shape.

The size of the resultant magnetic iron oxide particles may be easily controlled by the ratio of Fe(II)/Fe(III) in the ferrous salt solution.

In the process of producing a magnetic iron oxide by neutralizing a ferrous salt solution with an alkali in an amount exceeding the equivalent amount to produce a slurry of ferrous hydroxide and oxidizing the ferrous hydroxide, it is preferred that the ferrous hydroxide slurry has a pH of 9.0 or above. Below pH 9.0, the magnetic iron oxide particles produced tend to contain those having shapes other than octahedron in a large amount. On the other hand, if the alkali is added excessively, the particle size distribution is liable to be broadened. Accordingly, in order to produce octahedral particles in a large proportion while retaining a sharpe particle size distribution, it is preferred that the ferrous hydroxide slurry may have a pH of 9 or above, particularly 10 or above and the alkali may be used in an amount not exceeding 1.1 times, preferably 1.05 times, the equivalent of the ferrous salt. More specifically, the excessive alkali concentration in the solution after the neutralization of the ferrous salt with the alkali may preferably be 0.25 mol/l or below, particularly 0.125 mol/l or below.

With respect to the amount of the silicic acid compound to be added, less than 0.1 wt. % does not show a sufficient improvement effect on the particle characteristics as desired by the present invention, and more than 1.5 wt. % is not desirable because the silicic acid component remains increasingly on the particle surface.

The silicic acid compound to be added may for example be commercially available silicates such as sodium silicate or silicic acid in the form of a sol formed by hydrolysis. Aluminum sulfate, alumina or another additive can be added as far as it does not provide an ill effect to the magnetic iron oxide used in the invention.

As the ferrous salt, iron sulfate by-produced in titanium production by the sulfuric acid process or iron sulfate by produced in washing of steel sheets may generally be used, and it is also possible to use iron chloride.

In the production of magnetic iron oxide by the aqueous solution process, the iron concentration of 0.5–2.6 mol/l is generally used in order to prevent the increase in viscosity at the time of reaction and in view of the solubility of iron sulfate. There is generally a tendency that a lower iron sulfate concentration provides a smaller particle size of the product. In the reaction, a large amount of air for oxidation or a lower reaction temperature tends to provide smaller particles.

In the magnetic toner of the present invention, the magnetic iron oxide may be used in an amount of 20 wt. parts to 200 wt. parts, preferably 30–150 wt. parts, per 100 wt. parts of the binder resin.

The magnetic iron oxide used in the magnetic toner according to the invention may preferably be treated with a silane coupling agent, a titanium coupling agent, a titanate, an aminosilane, a hydrophobic polymer material or a surface active agent. Treatment with isopropyl triisostearoyl titanate (TTS) or aluminum stearate is particularly preferred. By such a treatment, it is possible to further improve the environmental characteristics and dispersibility and also adjust the chargeability.

In the case of a magnetic material treated with an agent containing silicon element such as a silane coupling agent, the overall content, content A and content B of silicon element defining the magnetic iron oxide used in the invention are obtained by removing the amount of silicon element originating from the treating agent.

The magnetic toner containing the magnetic iron oxide according to the present invention provides images free from fog and having a high density, which changes little under different environmental conditions. Further, the magnetic toner retains a proper charge even under low temperature-low humidity conditions and cause a density decrease due to charge up.

This may be attributable to the fact that the magnetic iron oxide used in the invention comprises magnetic iron oxide individual particles having a uniform size, composition and structure and also having an excellent fluidity compared with conventionally used magnetic iron oxide. As a result, in the toner of the invention, it is considered that the magnetic iron oxide is extremely uniformly dispersed into toner particles, and the individual toner particles also have physically and chemically uniform surface states. For this reason, the toner particles are considered to be provided with a stable and uniform charge so that images having a high density and free of fog can be produced.

The magnetic iron oxide used in the present invention is provided with the above features due to the silica component contained therein and also has a characteristic structural and compositional distribution that the silica content in a particle is decreased toward the surface at which the silica content is very low. As a result, compared with magnetic iron oxide containing silica component produced by the known production processes, the magnetic iron oxide has a low surface resistivity so that the resultant toner is considered to always retain a proper charge while obviating localized accumulation of charge, whereby a density decrease due to charge up is not caused even under low temperature-low humidity conditions.

The toner according to the invention contains little hydrophilic silica component at the surface, so that it does not cause lowering in charge due to moistening leading to a lowering in density even under high temperature-high humidity conditions.

As described above, the toner according to the present invention provides stable clear images with little change in density under various environmental conditions.

The magnetic toner according to the present invention may particularly suitably be used as a dry, positively chargeable, insulating one-component magnetic toner.

The binder for use in constituting the toner according to the present invention, when applied to a hot pressure roller fixing apparatus using an oil applicator, may be a known binder resin for toners. Examples thereof may include: homopolymers of styrene and its derivatives, such as polystyrene, poly-p-chlorostyrene, and polyvinyltoluene; styrene copolymers, such as styrene-p-chlorostyrene copolymer, styrene-vinyltoluene copolymer, styrenevinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrileindene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumarone-indene resin and petroleum resin.

In a hot pressure roller fixing system using substantially no oil application, more serious problems are provided by an offset phenomenon that a part of toner imge on a toner image-supporting member is transferred to a roller, and an intimate adhesion of a toner on the toner image-supporting member. As a toner fixable with a less heat energy is generally liable to cause blocking or caking in storage or in a developing apparatus, this should be also taken into consideration. With these phenomenon, the physical property of a binder resin in a toner is most concerned. According to our study, when the content of a magnetic material in a toner is decreased, the adhesion of the toner onto the toner image-supporting member mentioned above is improved, while the offset is more readily caused and also the blocking and caking are also more liable. Accordingly, when a hot roller fixing system using almost no oil application is adopted in the present invention, selection of a binder resin becomes more serious. A preferred binder resin may for example be a crosslinked styrene copolymer or a polyester. Examples of comonomers to form such a styrene copolymer may include one or more vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having double bonds and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ethers. As the crosslinking agent, a compound having two or more polymerizable double bonds may principally be used. Examples thereof include: aromatic divinyl compounds, such as divinylbenzene, and divinylnaphthalene; carboxylic acids having two double bonds, such as ethylene glycol diacrylate, ethylene glycol dimethacrylate, and 1,3-butanediol diacrylate; divinyl compounds such as divinyl ether, divinyl sulfide and divinyl sulfone; and compounds having three or more vinyl groups. These compounds may be used singly or in mixture. The crosslinking agent may preferably be used in such an amount that the resultant polymerized units of the crosslinking agent constitute 0.1–10 wt. %, particularly 0.2–5 wt. % of the polymer or copolymer constituting the binder resin.

For a pressure-fixing system, a known binder resin for pressure-fixable toner which is solid at room temperature may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, linear saturated polyesters and paraffins.

A positive charge controller may be added to the magnetic toner of the present invention, including for example: nigrosine and its modified products; quaternary ammonium salts, such as tributylbenzylammonium-1-hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclohexyltin borate. Such a positive charge controller may be used in an amount of 0.1–10 wt. parts per 100 wt. parts of the binder resin.

As another type of positive charge controller, there may be used a homopolymer of a monomer having an amino group represented by the formula:

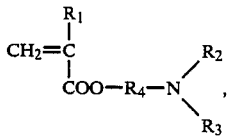

wherein $R_1$ represents H or $CH_3$; $R_2$ and $R_3$ each represent a substituted or unsubstituted alkyl group ($C_1$–$C_6$); and $R_4$ represents —$CH_2$—, —$C_2H_4$, or —$C_3H_6$—; or a copolymer of the monomer having an amine group with another polymerizable monomer such as styrene, acrylates, and methacrylates as described above. In this case, the positive charge controller also has a function of a binder. The homopolymer or copolymer functioning as a binder and positive charge controller can be used in a proportion of 1–100 wt. % of the binder resin of the magnetic toner.

The magnetic toner according to the present invention may preferably be provided with a silica fine powder externally added. A toner obtained by the combination of the magnetic iron oxide containing silicon element, a positive charge controller and a silica fine powder, shows a highly controlled and stabilized triboelectric charge which cannot be accomplished by any of the conventional toners.

The silica fine powder may be those produced through the dry process and the wet process.

The dry process referred to herein is a process for producing silica fine powder through vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention. It is preferred to use fine silica powder, of which mean primary particle size is desirably within the range of from 0.001 to 2 microns, particularly preferably from 0.002 to 0.2 micron.

Commercially available fine silica powder formed by vapor phase oxidation of a silicon halide to be used in the present invention include those sold under the trade names as shown below.

| | |
|---|---|
| AEROSIL (Nippon Aerosil Co.) | 130 |
| | 200 |
| | 300 |
| | 380 |
| | TT 600 |
| | MOX 80 |
| | MOX 170 |
| | COK 84 |
| Cab-O-Sil (Cabot Co.) | M-5 |
| | MS-7 |
| | MS-75 |
| | HS-5 |
| | EH-5 |
| Wacker HDK (WACKER-CHEMIE GMBH) | N 20 |
| | V 15 |
| | N 20E |
| | T 30 |
| | T 40 |

-continued

| | |
|---|---|
| D-C Fine Silica (Dow Corning Co.) | |
| Fransol (Fransil Co.) | |

On the other hand, in order to produce silica powder to be used in the present invention through the wet process, various processes known heretofore may be applied. For example, decomposition of sodium silicate with an acid represented by the following scheme may be applied:

$$Na_2O{\cdot}xSiO_2+HCl+H_2O \rightarrow SiO_2{\cdot}nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silica powder to be used herein may be anhydrous silicon dioxide (silica), and also a silicate such as aluminum silicate, sodium silicate, potassium silicate, magnesium silicate and zinc silicate.

Commercially available fine silica powders formed by the wet process include those sold under the trade names as shown below:

Carplex (available from Shionogi Seiyaku K.K.)
Nipsil (Nippon Silica K.K.)
Tokusil, Finesil (Tokuyama Soda K.K.)
Bitasil (Tagi Seihi K.K.)
Silton, Silnex (Mizusawa Kagaku K.K.)
Starsil (Kamishima Kagaku K.K.)
Himesil (Ehime Yakuhin K.K.)
Siloid (Fuki Devison Kagaku K.K.)
Hi-Sil (Pittsuburgh Plate Glass Co.)
Durosil, Ultrasil (Fülstoff-Gesellshaft Marquart)
Manosil (Hardman and Holden)
Hoesch (Chemische Fabrik Hoesch K-G)
Sil-Stone (Stoner Rubber Co.)
Nalco (Nalco Chem. Co.)
Quso (Philadelphia Quartz Co.)
Imsil (Illinois Minerals Co.)
Calcium Silikat (Chemische Fabrik Hoesch, K-G)
Calsil (Füllstoff-Gesellschaft Marquart)
Fortafil (Imperial Chemical Industries)
Microcal (Joseph Crosfield & Sons. Ltd.)
Manosil (Hardman and Holden)
Vulkasil (Farbenfabriken Bayer, A.G.)
Tufknit (Durham Chemicals, Ltd.)
Silmos (Shiraishi Kogyo K.K.)
Starlex (Kamishima Kagaku K.K.)
Furikosil (Tagi Seihi K.K.).

Among the above mentioned silica powders, those having a specific surface area as measured by the BET method with nitrogen adsorption of 30 $m^2/g$ or more, particularly 50–400 $m^2/g$, provides a good result.

Examples of adding fine silica powder formed by vapor phase oxidation of a silicon halide to a toner for electrophotography are known in the art. However, even a toner containing a dye having positive charge controlling characteristic is liable to be changed thereby to negative in its charging polarity and therefore unsuitable for visualization of negative electrostatic images or visualization of positive electrostatic images through reversal development.

In order to obtain positively chargeable silica fine powder, the above mentioned silica powder obtained through the dry or wet process may be treated with a silicone oil having an organic groups containing at least one nitrogen atom in its side chain, a nitrogen-containing silane coupling agent, or both of these.

In the present invention, "positively chargeable silica" means one having a positive triboelectric charge when measured by the blow-off method.

The silicone oil having a nitrogen atom in its side chain may be a silicone oil having at least the following partial structure:

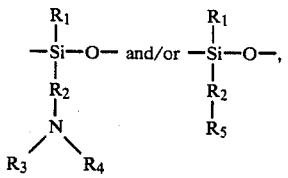

wherein $R_1$ denotes hydrogen, alkyl, aryl or alkoxyl; $R_2$ denotes alkylene or phenylene; $R_3$ and $R_4$ denotes hydrogen, alkyl, nitrogen-containing heterocyclic group, or aryl; and $R_5$ denotes a nitrogen-containing heterocyclic group. The above alkyl, aryl, alkylene and phenylene group can contain an organic group having a nitrogen atom, or have a substituent such as halogen within an extent not impairing the chargeability.

The nitrogen-containing silane coupling agent used in the present invention generally has a structure represented by the following formula:

RmSiYn, wherein R is an alkoxy group or a halogen atom; Y is an amino group or an organic group having at least one nitrogen atom; and m and n are integers of 1–3 satisfying the relationship of m+n=4.

The organic group having at least one nitrogen group may for example be an amino group having an organic group as a substituent, a nitrogen-containing heterocyclic group, or a group having a nitrogen-containinig heterocyclic group. The nitrogen-containing heterocyclic group may be unsaturated or saturated and may respectively be known ones. Examples of the unsaturated heterocyclic ring structure providing the nitrogen-containing heterocyclic group may include the following:

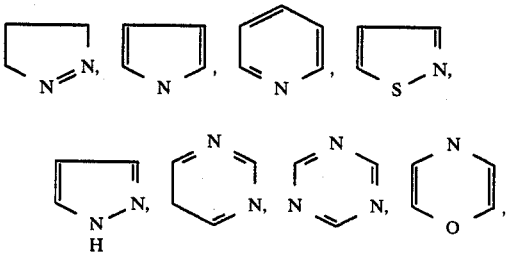

-continued

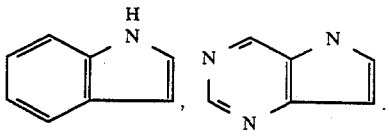

Examples of the sturated heterocyclic ring structure include the following:

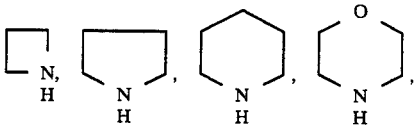

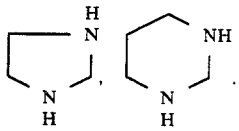

The hetrocyclic groups used in the present invention may preferably be those of five-membered or six-membered rings.

Examples of the silane coupling agent include: aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine. Further, examples of the nitrogen-containing heterocyclic compounds represented by the above structural formulas include: trimethoxysilyl-γ-propylpiperidine, trimethoxysilyl-γ-propylmorpholine, and trimethoxysilyl-γ-propylimidazole.

The thus treated silica powder shows an effect when added in an amount of 0.01–10 wt. parts and more preferably may be used in an amount of 0.03–5 wt. parts, further preferably 0.1–2 wt. parts, respectively based on the magnetic toner weight, to show a positive chargeability with excellent stability. As a preferred mode of addition, the treated silica powder in an amount of 0.01–3 wt. % based on the developer weight should preferably be in the form of being attached to the surface of the toner particles.

The silica powder used in the present invention may be treated as desired with another silane coupling agent or with an organic silicon compound for the purpose of enhancing hydrophobicity. The silica powder may be treated with such agents in a known manner so that they react with or are physically adsorbed by the silica powder. Examples of such treating agents include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

It is preferred that the fine silica powder is treated to finally have a hydrophobicity in the range of 30–80 as measured by the methanol titration test since a developer containing the silica powder treated in this way shows a sharp and uniform triboelectric charge of a positive polarity. Herein, the methanol titration test provides a measure of the hydrophobicity of the silica fine particles having hydrophobicity-impartes surfaces.

The "methanol titration test" defined in the present invention for evaluating the hydrophobicity of the treated silica powder is conducted in the following manner. Sample fine silica powder (0.2 g) is charged into 50 ml of water in 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the fine silica powder is suspended in the liquid, and the hydrophobicity is represented by the percentage of the methanol in the liquid mixture of water and methanol on reaching the end point.

The particularly excellent characteristic provided by a developer for developing electrostatic images obtained by adding positively chargeable silica powder to the magnetic toner according to the present invention, is that the developer does not cause a decrease in image density even when it is used continuously for a long period of time but retains a high quality of image at the initial stage. This is presumably because the developer obtained by the combination of the magnetic toner and the positively chargeable fine silica powder has a constant triboelectric charge, and the distribution thereof is sharp.

The magnetic toner according to the present invention may for example be produced in the following manner. A toner composition comprising a binder resin, the magnetic iron oxide powder and a charge controller is subjected to preliminary blending by means of a mixer such as a ball mill. The resultant blend, after cooling, is crushed into a size of several mm or smaller by means of a crusher such as a hammer mill and is finely pulverized by means of a supersonic jet pulverizer. The resultant particles are fine particles having sizes on the order of 0.1–50 microns. The particles are classified to obtain a toner having a volume-average particle size of about 2–20 microns. At this time, a toner having a prescribed particle size distribution may be prepared by controlling the pulverization conditions to set the particle size distribution before the classification and by setting the classification conditions depending on the specific gravity and the feed rate of the toner. Examples of classifiers which may be used for separation of finer size powder include wind force classifiers such as Mikroplex 132MP (mfd. by Alpine Co.), Acucut A-12 (mfd. by Donaldson Co.) and Micron Separator-MS-1 (mfd. by Hosokawa Micron K.K.). Coarser particles may be cut by using, e.g., a windforce classifier such as Mikroplex 400 MP (mfd. by Alpine Co.) or Micron Separator MS-1 (mfd. by Hosokawa Micron K.K.) or a shieve such as Blower Sifter (mfd. by Taiko K.K.).

In the above, the toner production through pulverization has been explained. However, the toner may also be produced through various processes including the suspension polymerization process and the microencapsulation process.

Next, some examples of production of magnetic iron oxide powder containing silicon element will be described.

PRODUCTION EXAMPLE 1

53 kg of ferrous sulfate for industrial use ($FeSO_4.7H_2O$, iron content: about 19%) was dissolved in 50 lit. of water and the solution was warmed with steam to form a solution maintained at 40° C. and having an iron concentration of 2.4 mol/l. Air was blown into the solution to adjust the Fe(II)/Fe(III) ratio to 50. Then, 560 g of sodium silicate having an SiO content of 28% (corresponding to 156.8 g of SiO) was dissolved in 13 lit. of water to form a solution, which was then adjusted with respect to pH and added to the above ferrous sulfate solution.

13.2 kg of caustic soda was dissolved in 50 lit. of water, and the solution was used for neutralization of about 80 lit. of the ferrous sulfate solution containing silicic acid component under mechanical stirring. The excessive caustic soda in the ferrous sulfate slurry was adjusted to a concentration of 2 g/l by using caustic soda. Air was blown at a rate of 37 l/min into the slurry while maintaining the temperature at 85° C. to complete the reaction in 5.5 hours. Then, the solid in the slurry was washed and dried to obtain a magnetic iron oxide containing silicon element. The content of the silicon element in the magnetic iron oxide was measured to be 0.72 wt. % based on the iron element.

With respect to the magnetic iron oxide thus obtained, the content A of silicon element up to about 10 % dissolution of iron element was 0.43 wt. %, the content B of silicon element in the range of 90–100 wt. % dissolution of iron element was 1.58 wt. %, and the content ratio B/A was about 3.7. The apparent bulk density was 0.22 g/cc, the dispersibility in toluene was 1 mm in terms of sedimentation length in 1 hour, and the BET specific surface area was 8.1 $m^2/g$. As a result of the observation and measurement through a transmission electron microscope, the magnetic iron oxide showed an average diameter of 0.25 micron, was substantially free of spherical particles and most particles have the shape of a tetrahedron.

The dissolved iron element and silicon element measured at each ten minutes are given in the following Table 1, and the calculation of the contents A and B will be explained.

TABLE 1

| | | Dissolution time (min) | | | | | | | | | | | | | | |
|---|---|---|---|---|---|---|---|---|---|---|---|---|---|---|---|---|
| | | 10 | 20 | 30 | 40 | 50 | 60 | 70 | 80 | 90 | 100 | 110 | 120 | 130 | 140 | 150 |
| Iron dissolved | mg/l | 80 | 170 | 340 | 550 | 840 | 1150 | 1570 | 1970 | 2460 | 2750 | 3040 | 3110 | 3200 | 3220 | 3220 |
| Iron dissolved | wt. % | 2.48 | 5.28 | 10.6 | 17.1 | 26.1 | 35.7 | 48.8 | 61.2 | 76.4 | 85.4 | 94.4 | 96.6 | 99.4 | 100 | 100 |
| Silicon | mg/l | 0.67 | 0.98 | 1.47 | 2.16 | 3.17 | 4.47 | 6.54 | 8.95 | 12.9 | 16.3 | 20.0 | 21.4 | 22.8 | 23.0 | 23.1 |

TABLE 1-continued

| | | Dissolution time (min) | | | | | | | | | | | | | | |
|---|---|---|---|---|---|---|---|---|---|---|---|---|---|---|---|---|
| | | 10 | 20 | 30 | 40 | 50 | 60 | 70 | 80 | 90 | 100 | 110 | 120 | 130 | 140 | 150 |
| dissolved Silicon dissolved | wt. % | 2.90 | 4.24 | 6.36 | 9.35 | 13.7 | 19.3 | 28.3 | 38.7 | 55.8 | 70.6 | 86.6 | 92.6 | 98.7 | 99.6 | 100 |

The measured data shown in Table 1 gave a graph shown in FIG. 1 wherein the measured data are plotted with the abscissa of dissolution rate of iron element (wt. %) and the ordinate of dissolution rate of silicon element. From the graph, the dissolution rate of silicon element is read at the 10% dissolution of iron element, and then the dissolved amount of silicon element is obtained. Separately, the dissolved amount of iron element at the 10% dissolution of iron element is obtained. By using these data, the content A is calculated by the following equation:

Content A = [dissolved amount of silicon element at 10% dissolution of iron element (mg/l)/dissolved amount of iron element at 10 wt. % dissolution of iron element] × 100
= [23.1 × 0.06/3220 × 0.1] × 100
= 0.43 wt. %

From the graph, the dissolved amount of silicon element and dissolved amount of iron element in the range of 90 wt. %–100 wt. % dissolution of iron element are respectively obtained by subtracting the respective values at the 90 wt. % dissolution from the respective values at the 100 wt. % dissolution, and the content B is calculated by using these data as follows:

Content B = [dissolved amount of silicon element in the range of 90 wt. %–100 wt. % dissolution of iron element/dissolved amount of iron element in the range of 90 wt. %–100 wt. % dissolution of iron element] × 100
= [23.1 × 0.22/3220 × 0.1] × 100
= 1.58 wt. %

PRODUCTION EXAMPLES 2–4

The procedure of Production Example 1 was repeated by changing the Fe(II)/Fe(III) ratio, the amount of addition of sodium silicate, and the remaining caustic soda concentration at the time of neutralization, respectively, as shown in Table 2 appearing hereinafter, whereby magnetic iron oxide products having properties satisfying the requirements of the present invention as also shown in Table 2 were obtained.

COMPARATIVE PRODUCTION EXAMPLE 1

The procedure of Example 4 was repeated except that the sodium silicate aqueous solution was not added to obtain a magnetic iron oxide. The magnetic iron oxide obtained showed the content of silicon element based on the iron element of 0.02 wt. %. The magnetic iron oxide showed fractionally dissolved silicon contents (A and B) of about 0.03 wt. % respectively up to 10 wt. % dissolution and in the range of 90–100 wt. % dissolution of iron element; and the silicon element was considered to have been introduced from water and the like.

The resultant magnetic iron oxide showed an apparent bulk density of 0.32 g/cc, a dispersibility in toluene in terms of sedimentation length in 1 hour of 7 mm, a BET specific surface area of 6 $m^2/g$, and an average particle size of 0.35 micron by observation and measurement by a transmission electron microscope.

COMPARATIVE PRODUCTION EXAMPLE 2

The procedure of Production Example 3 was repeated except that the oxidation was conducted under an acidic condition of pH 6.4–7.4. The properties of the product magnetic iron oxide are shown in the following Table 2 together with those of the above Production Examples and Comparative Production Example 1.

TABLE 2

| | Production conditions | | | Physical properties of magnetic iron oxide | | | | | | |
|---|---|---|---|---|---|---|---|---|---|---|
| | Fe (II)/ Fe (III) | Sodium silicate $Si/Fe_3O_4$ (%) | Neutralization conditions | Content A (wt. %) | Content B (wt. %) | B/A | Bulk density (g/cc) | Dispersibility in toluene (mm) | Specific surface area ($m^2/g$) | Overall content of Si element (%) |
| Prod. Ex. | | | | | | | | | | |
| 1 | 50 | 0.5 | $NaOH_2$ g/l | 0.43 | 1.58 | 3.7 | 0.20 | 0 | 8.4 | 0.72 |
| 2 | 60 | 0.4 | " | 0.28 | 1.23 | 4.4 | 0.19 | 0 | 8.0 | 0.56 |
| 3 | 80 | 0.3 | " | 0.36 | 1.07 | 3.0 | 0.22 | 1 | 8.8 | 0.44 |
| 4 | 100 | 0.2 | " | 0.37 | 0.68 | 1.8 | 0.19 | 1 | 10.6 | 0.31 |
| Comp. Prod. Ex. | | | | | | | | | | |
| 1 | 100 | 0 | " | — | — | — | 0.32 | 7 | 6.0 | — |
| 2 | 80 | 0.3 | pH 6.4–7.4 | 2.51 | 0.26 | 0.10 | 0.48 | 34 | 11.5 | 0.44 |

Hereinbelow, the present invention will be explained by way of Examples.

EXAMPLE 1

| | |
|---|---|
| Styrene/2-ethylhexyl acrylate/divinyl benzene copolymer (copolymerization wt. ratio: 80/15/5, weight-average molecular weight: 380,000) | 100 wt. parts |
| Nigrosine | 4 wt. parts |
| Low-molecular weight polypropylene | 4 wt. parts |
| Magnetic iron oxide of Production Example 1 | 60 wt. parts |

The above ingredients were well blended in a blender and melt-kneaded at 160° C. by means of a roll mill. The kneaded product was cooled, coarsely crushed by a hammer mill, finely pulverized by means of a pulverizer using jet air stream, and classified by a wind-force classifier to obtain a positively chargeable, electrically insulating black powder having a volume-average particle size of about 11 microns.

To 100 wt. parts of the black powder was added 0.5 wt. part of a positively chargeable hydrophobic colloidal silica treated with an amino-modified silicone oil, followed by blending by means of a Henschel mixer to obtain a positively chargeable, one-component, insulating, magnetic toner. The toner was used for developing a negatively charged latent image to effect image formation in a commercially available copier (NP3525, mfd. by Canon K.K.), whereby an image having a high density of 1.29, free of fog and a high resolution was obtained under normal temperature and normal humidity conditions. Further, under low temperature-low humidity (15° C., 10 %) conditions and high temperature-high humidity (35° C., 85 %) conditions, image densities of 1.30 and 1.28 were obtained with little difference in image density. When the toner was subjected to 50,000 sheets of repetitive copying operation, the image density was stable, and there was observed no problematic fog or reversal fog in a white erased portion when a region-specifying function was utilized.

The toner was set into a solid piece with an epoxy resin and sliced by a microtome into a 2 micron-thick film sample, which was then observed through a scanning microscope with respect to a reflection image. As a result, the magnetic iron oxide particles were found to be uniformly dispersed in the toner particles.

EXAMPLE 2-4

Example 1 was repeated except that the magnetic iron oxide of Production Example 1 was replaced by those of Production Examples 2-4, respectively. The resultant toner products all provided images with high densities and little change in image density under the different sets of conditions, and the performances were stable under repetitive copying operations.

EXAMPLE 5

A negatively chargeable insulating magnetic toner was prepared in a substantially similar manner as in Example 1 except that the ingredients of 100 wt. parts of polyester resin, 50 wt. parts of the magnetic iron oxide of Production Example 1 and 3 wt. parts of a chromium complex were used. A developer was prepared by mixing 100 wt. parts of the toner with 0.5 wt. part of a negatively chargeable, hydrophobic, dry-process silica, and the developer was used to develop a positively charged latent image for image formation in a commerciall available copying machine (NP 7550, mfd. by Canon K.K.), whereby clear images with a high density were obtained with little change under various environmental conditions and stable performances under repetitive copying operations.

COMPARATIVE EXAMPLE 1

A toner was prepared and evaluated in the same manner as in Example 1 except that the magnetic iron oxide of Comparative Production Example 1 was substituted for the magnetic iron oxide of Production Example 1.

Under normal temperature and normal humidity conditions, slight noticeable fog was observed compared with the result in Example 1. Under the low temperature-low humidity conditions, the fog was more noticeable and the image density was lowered during the 30,000 sheets of repetitive copying from 1.26 at the initial stage of 1.09. Under the high temperature-high humidity conditions, the image density was as low as 1.01 from the outset and lowered to 0.86 by the 30,000 sheets of repetitive copying.

When the toner was set with an epoxy resin and sliced by a microtone into a 2 micron-thick film sample, which was then observed through a scanning microscope with respect to a reflection image. As a result, the magnetic particles were localized in the agglomerated form in the toner particle, wherein a large portion free of magnetic particles was observed.

COMPARATIVE EXAMPLE 2

A toner was prepared and evaluated in the same manner as in Example 1 except that the magnetic iron oxide of Comparative Production Example 2 was substituted for the magnetic iron oxide of Production Example 1.

Under normal temperature and normal humidity conditions, fog was observed compared with the result in Example 1. Under the low temperature-low humidity conditions, the fog was also more noticeable and the image density was lowered during repetitive copying from 1.28 at the initial stage of 1.20 on copying of 30,000 sheets, and to 1.13 on 50,000 sheets. Under the high temperature-high humidity conditions, the image density was lowered from 1.22 at the initial stage to 1.13 on copying of 30,000 sheets and to 1.08 on 50,000 sheets.

The developing characteristics of the toner prepared and evaluated in the respective Examples and Comparative Examples are inclusively shown in the following Table 3.

TABLE 3

| | Image density | | | Image density on repetitive copying (32.5° C., 85%) | |
|---|---|---|---|---|---|
| | Normal temp.-normal humidity (23.5° C., 60%) | Low temp.-low humidity (10° C., 15%) | High temp.-high humidity (32.5° C., 85%) | 30000 sheets | 50000 sheets |
| Example | | | | | |
| 1 | 1.29 | 1.30 | 1.28 | 1.30 | 1.29 |
| 2 | 1.28 | 1.29 | 1.28 | 1.29 | 1.27 |
| 3 | 1.27 | 1.28 | 1.27 | 1.27 | 1.25 |
| 4 | 1.29 | 1.29 | 1.28 | 1.28 | 1.26 |
| 5 | 1.31 | 1.32 | 1.30 | 1.30 | 1.28 |
| Comp. Example | | | | | |
| 1 | 1.16 | 1.26 | 1.01 | 0.86 | — |

TABLE 3-continued

| | Image density | | | Image density on repetitive copying (32.5° C., 85%) | |
|---|---|---|---|---|---|
| | Normal temp.-normal humidity (23.5° C., 60%) | Low temp.-low humidity (10° C., 15%) | High temp.-high humidity (32.5° C., 85%) | 30000 sheets | 50000 sheets |
| 2 | 1.25 | 1.28 | 1.22 | 1.13 | 1.08 |

EXAMPLE 6

| | |
|---|---|
| Styrene/butyl acrylate/dimethylaminoethyl methacrylate/divinylbenzene copolymer (copolymerization wt. ratio: 80:15:4:1, weight-average molecular weight: about 190,000) | 100 wt. parts |
| Low-molecular weight polypropylene | 4 wt. parts |
| Magnetic iron oxide of Production Example 1 | 60 wt. parts |

A positively chargeable, one-component, insulating, magnetic toner was prepared by using the above ingredients in the same manner as in Example 1. In the same manner as in Example 1, the magnetic toner was used for development of a negatively charged latent image, whereby a clear image with an image density of 1.26 was obtained. Similarly clear images were obtained also under the high temperature-high humidity conditions and under the low temperature-low humidity conditions. Good results were also obtained under the repetitive copying test.

What is claimed is:

1. A magnetic toner comprising a binder resin and a magnetic portion, said magnetic portion comprising iron oxide and 0.1–1.5 wt. % silicon (based on total iron content), provided that an amount (A) of at most 0.7 wt. % silicon (based on iron content) when said magnetic portion is dissolved in an amount of not more than about 10 wt. % based on said total iron content and an amount (B) of 0.2–5 wt. % silicon (based on iron content) when the magnetic portion is dissolved in an amount of about 90–100 wt. % based on said total iron content, are present in a ratio of B/A of above 1.

2. A magnetic toner according to claim 1, wherein the magnetic portion has an average particle size of 0.1–2.0 microns.

3. A magnetic toner according to claim 2, wherein the magnetic portion has an average particle size of 0.1–0.6 micron.

4. A magnetic toner according to claim 1, wherein the magnetic portion has an average particle size of 0.1–0.6 micron and a BET specific surface area by nitrogen adsorption of 0.5–20 $m^2/g$.

5. A magnetic toner according to claim 4, wherein the magnetic portion has a BET specific surface area by nitrogen adsorption of 4–20 $m^2/g$.

6. A magnetic toner according to claim 1, wherein the magnetic portion is contained in a proportion of 20–200 wt. parts per 100 wt. parts of the binder resin.

7. A magnetic toner according to claim 6, wherein the magnetic portion is contained in a proportion of 30–150 wt. parts per 100 wt. parts of the binder resin.

8. A magnetic toner according to claim 6, wherein the binder resin comprises a crosslinked styrene copolymer.

9. A magnetic toner according to claim 6, wherein the binder resin comprises a polyester resin.

10. A magnetic toner according to claim 1, wherein the binder resin comprises a homopolymer or copolymer of a monomer having amine group represented by the formula:

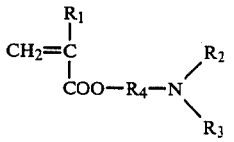

wherein $R_1$ represents H or $CH_3$; $R_2$ and $R_3$ each represent a substituted or unsubstituted alkyl group ($C_1$–$C_6$); and $R_4$ represents $—CH_2—$, $—C_2H_4$, or $—C_3H_6$.

11. A magnetic toner according to claim 10, wherein the binder resin comprises a copolymer of the monomer having amine group and a polymerizable monomer selected from the group consisting of styrene, acrylates, and methacrylates.

12. A magnetic toner according to claim 1, which further comprises a positive charge controller.

13. A magnetic toner according to claim 1, which is blended with silica fine powder.

14. A magnetic toner according to claim 13, wherein the silica fine powder comprises a positively chargeable silica.

15. A magnetic toner according to claim 13, wherein the silica fine powder has been produced through a wet process.

16. A magnetic toner according to claim 14, wherein the silica fine powder has been surface-treated with a silicone oil having an organo group cotaining at least one nitrogen atom in its side chain.

17. A magnetic toner according to claim 14, wherein the silica fine powder has a hydrophobicity of 30–80.

18. A magnetic toner according to claim 13, wherein the silica fine powder is blended in a proportion of 0.01–3 wt. parts with 100 wt. parts of the magnetic toner.

19. A magnetic toner according to claim 1, wherein the magnetic portion has a content of silicon element of 0.2–1.0 wt. % based on the iron element.

20. A magnetic toner according to claim 19, wherein the magnetic portion has a content of silicon element of 0.25–0.7 wt. % based on the iron content.

21. A magnetic toner according to claim 1, wherein the magnetic portion has a content A of silicon element as defined of 0.1–0.5 wt. %.

22. A magnetic toner according to claim 1, wherein the magnetic portion has a content B of silicon element as defined of 0.5–3 wt. %.

23. A magnetic toner according to claim 1, wherein the magnetic portion has an apparent bulk density of 0.10–0.25 g/cc.

24. A magnetic toner according to claim 1, wherein the magnetic portion has a dispersibility in toluene of 4 mm or less in terms of a sedimentation length after standing for 1 hour.

25. A magnetic toner according to claim 1, which is a dry, positively chargeable, insulating, onecomponent, magnetic toner.

26. A magnetic toner according to claim 1, which further comprises nigrosine or modified nigrosine.

27. A magnetic toner according to claim 26, wherein the nigrosine or modified nigrosine is contained in a proportion of 0.1–10 wt. parts per 100 wt. parts of the binder resin.

28. A magnetic toner according to claim 1, wherein said magnetic portion is octahedral.

29. A magnetic toner according to claim 25, wherein said magnetic portion has an apparent bulk density of 0.10–0.25 g/cc.

* * * * *

UNITED STATES PATENT AND TRADEMARK OFFICE

CERTIFICATE OF CORRECTION

PATENT NO. : 4,820,603

DATED : April 11, 1989

INVENTOR(S) : KIICHIRO SAKASHITA

It is certified that error appears in the above-identified patent and that said Letters Patent is hereby corrected as shown below:

IN [57] ABSTRACT

Line 4, "form" should read --form of--.

COLUMN 2

Line 11, "methdos" should read --methods--.
Line 40, "irregularieis" should read --irregularities--.

COLUMN 4

Line 15, "process" should read --processes--.
Line 25, "invetion" should read --invention--.

COLUMN 5

Line 15, "in" should read --in the--.

COLUMN 6

Line 61, "meausred" should read --measured--.

COLUMN 9

Line 58, "imge" should read --image--.

UNITED STATES PATENT AND TRADEMARK OFFICE

CERTIFICATE OF CORRECTION

PATENT NO. : 4,820,603

DATED : April 11, 1989

INVENTOR(S) : KIICHIRO SAKASHITA

It is certified that error appears in the above-identified patent and that said Letters Patent is hereby corrected as shown below:

COLUMN 16

Line 55, "tetrahedron." should read --octahedron.--.

COLUMN 20

Line 26, "sample." should read --sample,--.

COLUMN 22

Line 67, "onecomponent," should read --one-component,--.

COLUMN 24

Line 3, "claim 25," should read --claim 28,--.

Signed and Sealed this

Twentieth Day of February, 1990

*Attest:*

JEFFREY M. SAMUELS

*Attesting Officer*

*Acting Commissioner of Patents and Trademarks*